US005296289A

United States Patent [19]

Collins

[11] Patent Number: 5,296,289

[45] Date of Patent: Mar. 22, 1994

[54] STRETCHABLE SPUN BONDED NONWOVEN WEB AND METHOD

[76] Inventor: Loren M. Collins, 2010 S. Ocean Blvd., North Myrtle Beach, S.C. 29582

[21] Appl. No.: 876,753

[22] Filed: Apr. 29, 1992

[51] Int. Cl.[5] ..... D04H 3/14; D06C 3/02

[52] U.S. Cl. ..... 428/296; 26/51; 428/198

[58] Field of Search ..... 428/198, 296; 26/51

[56] References Cited

U.S. PATENT DOCUMENTS 3,855,045 12/1974 Brock ..... 428/198
3,949,128 4/1976 Ostermeier ..... 428/221
4,374,888 2/1983 Bornslaeger ..... 428/198
4,741,944 5/1988 Jackson et al. ..... 428/171
5,057,357 10/1991 Winebarger ..... 428/195
5,116,662 5/1992 Morman ..... 428/198
5,128,193 7/1992 Anapol ..... 428/171

*Primary Examiner*—James C. Cannon
*Attorney, Agent, or Firm*—Ralph Bailey

[57] ABSTRACT

A spun bonded nonwoven web having spaced autogenous spot bonds A has continuous ribs B of filaments therebetween extending axially in the machine direction as well as continuous ribs C extending axially in the cross direction throughout the web, said nonwoven web having been subjected to axial stretching and elongation with increased area and reduction in basis weight by at least about thirty (30%) percent.

14 Claims, 7 Drawing Sheets

Fig. 9.
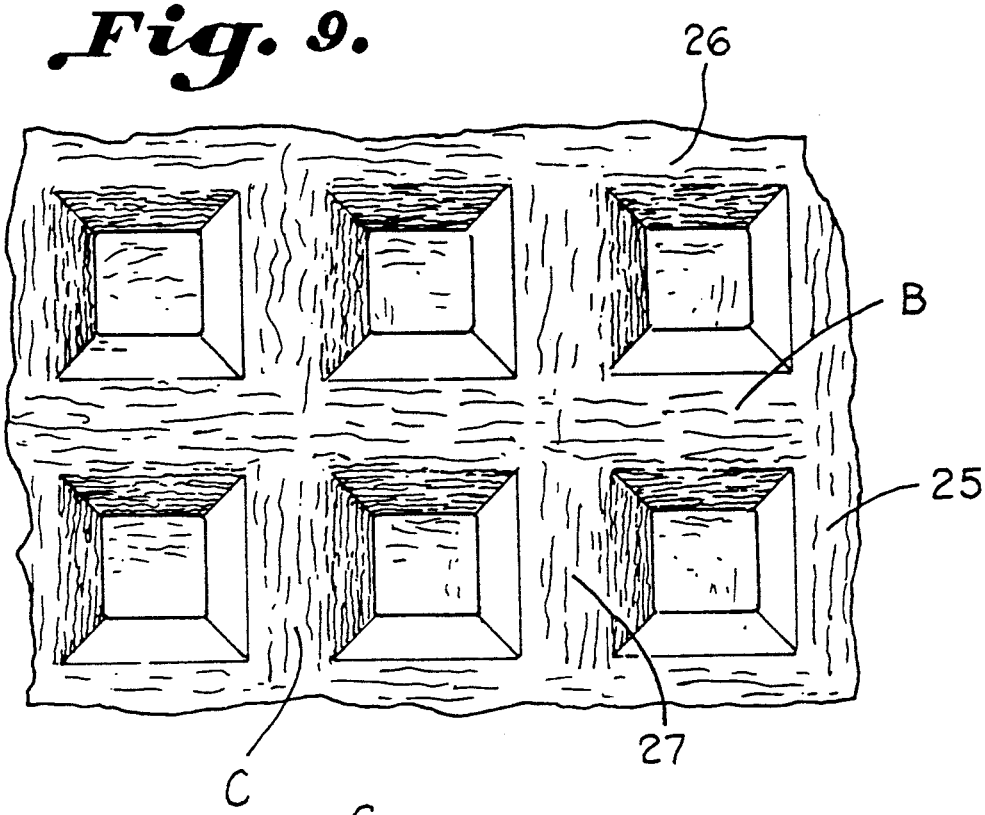
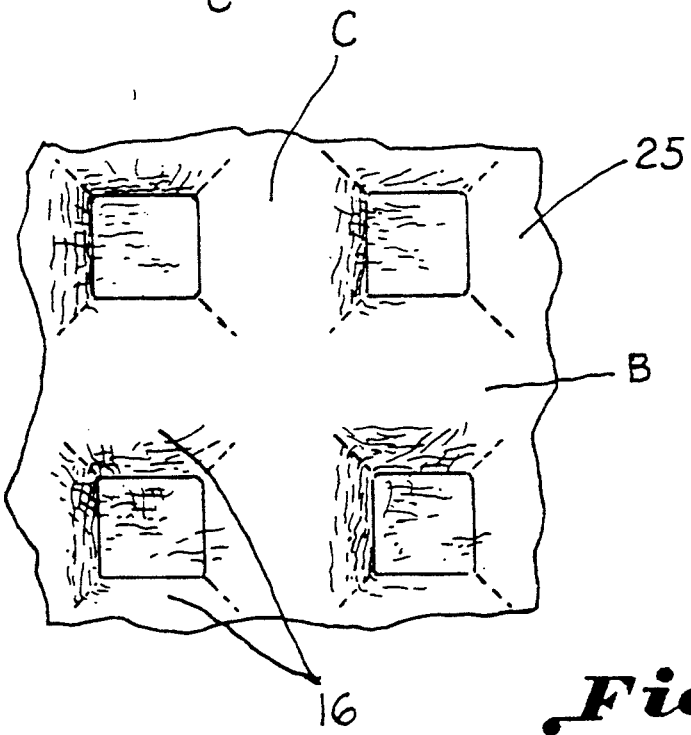
Fig. 10.

SUBJECT NON WOVENS
NORMAL
STRETCHED
NORMAL PRIOR ART
STRETCHED PRIOR ART
3.09
2.89
2.64
2.07
4
3
2
1
0
50
51.6
100
88.4
150
143.4
130.7
ELONGATION %
TENSILE STRENGTH IN Kg.

STRETCHABLE SPUN BONDED NONWOVEN WEB AND METHOD

BACKGROUND OF THE INVENTION

Spun bonded nonwoven webs having autogenous spot bonds are described in U.S. Pat. No. 3,855,046, Hansen et al. U.S. Pat. No. 3,949,128 illustrates elastic spun bonded nonwovens having spot bonds arranged in a pattern which is elongated and distorted in response to forces exerted in the machine direction causing the filaments to buckle between the spot bonds with subsequent heat setting. Stretchability in the cross direction may be achieved by a later microcreping process. An increase in basis weight is caused by such bulking. U.S. Pat. No. 4,374,888 illustrates a non-woven laminate including exterior layers of spun bonded nonwoven webs each having autogenous bonds arranged in widely dispersed patterns of spot bonds in side by side relation and in rows both in the machine direction and in the cross direction and having an intermediate melt blown layer. These layers are pattern bonded utilizing a sonic horn.

It is an important object of this invention to provide a spun bonded nonwoven web which has been stretched to provide a soft "hand" and greater coverage with minimal sacrifices in strength as a result of stretching in either the machine direction or in the cross direction although there is a substantial reduction in basis weight of the web commensurate with the amount of dimensional increases.

Another important object of the invention is the provision of a spun bonded nonwoven web having a symmetrical pattern of autogenous spot bonds arranged in such a way as to provide marginal "secondary bonding" from which portions of continuous filament become disengaged when the web is subjected to stress in the machine direction or in the cross direction prior to release of the filaments in the spot bond.

Still another object of this invention is to increase the stretchability of a spun bonded nonwoven web having spot bonds arranged in a pattern conducive to symmetrical displacement upon the application of stress in the machine direction or in the cross direction.

SUMMARY OF THE INVENTION

A soft stretchable spun bonded nonwoven web has spot bonds distributed in a pattern providing spaced rows of spaced soft bonds in side by side relation in the machine direction and in the cross direction producing continuous strips or ribs of unbonded or partially bonded filaments in the machine direction as well as similar continuous strips or ribs in the cross direction throughout the web.

Such a "cornrow" bond pattern produces a larger primary bond area as a percentage of total area as well as a "secondary" bonding of the marginal filaments. The cornrow bond pattern produces a material which is stronger than would normally be expected because of the secondary bonding. This secondary bonding may be caused by the relative closeness of the bond points, such that the bond points merge at the edges producing secondary bonding.

Not only is there less primary bond area but also secondary bonding is not present in the "staggered" bond pattern of the prior art. Such prior art is illustrated in the aforementioned U.S. Pat. No. 3,949,128. In such a conventional staggered pattern, spot bonds are each isolated in a wider staggered pattern making discrete bonds with minimal secondary bonding.

When spun bonded nonwoven webs constructed in accordance with the invention are stretched, the secondary bonds are broken, and tensile strength and elongation are slightly reduced. However, stretching of prior art webs breaks primary spot bonds or breaks filaments from the bond points, producing similar effects which will greatly reduce the relatively lower strengths and elongation values possessed by such webs before stretching.

Here stretching will improve the hand and "loft" of the material with acceptable losses in tensile strengths and elongation characteristics. Stretching of prior art materials will improve the hand somewhat, but with unacceptable losses in strength and stretchability.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 9 is an enlarged top plan view further illustrating a nonwoven web having continuous strips or ribs in the machine direction and in the cross direction in accordance with the present invention;

FIG. 10 is a bottom plan view illustrating the web illustrated in FIG. 9;

DESCRIPTION OF A PREFERRED EMBODIMENT

Figure 1:
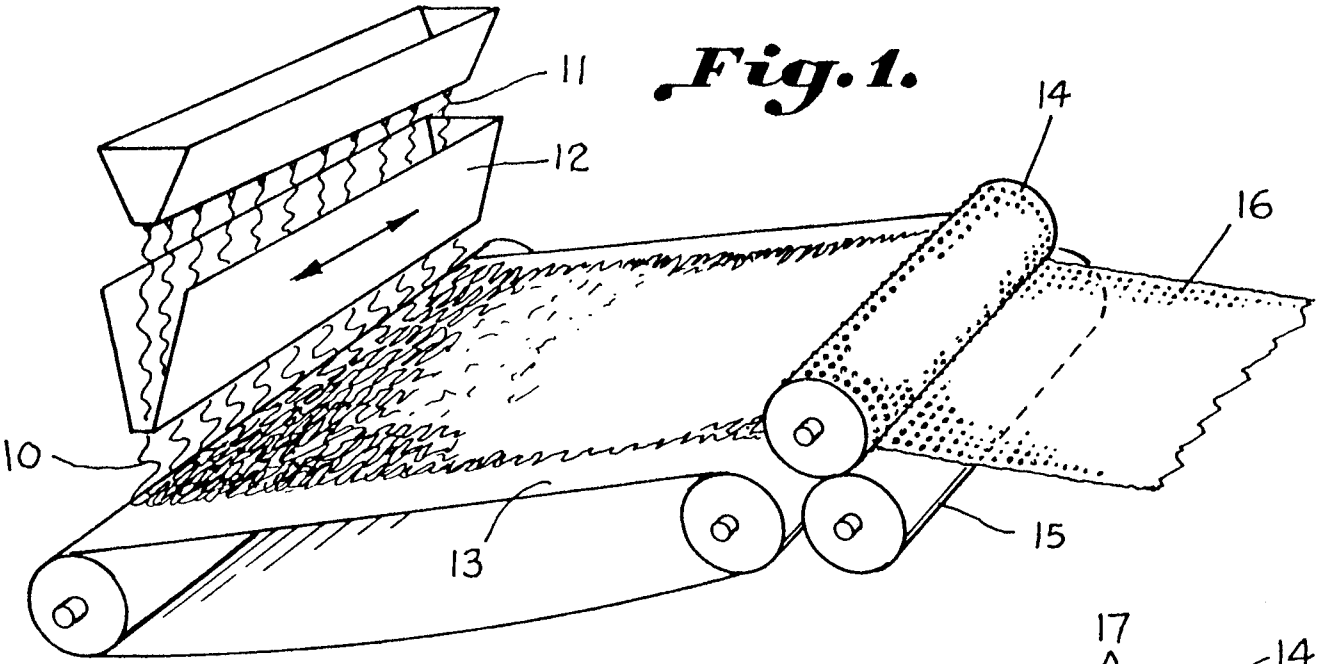
FIG. 1 is a perspective view illustrating conventional apparatus for manufacturing a spun bonded nonwoven web which is thereafter spot bonded in accordance with a roll bearing a special pattern producing a web constructed in accordance with the present invention.

The drawings illustrate a stretchable spun bonded nonwoven web as well as apparatus and method for making same creating a soft high loft web. A plurality of continuous and randomly deposited, molecularly oriented filaments of a thermoplastic polymer form a web having a plurality of spaced spot bonds A of autogenous releasable filament bonds having been formed by passing said web between a roll with a raised pattern thereon and another opposed roll exerting pressure and applying heat to the web. The spot bonds are distributed in a pattern providing continuous strips or ribs B of filaments therebetween in the machine direction as well as continuous strips or ribs C in the cross direction throughout the web.

The pattern is such that the spot bonds are in rows and in side by side relation in both the machine direction and in the cross direction. The continuous strips are of such width that respective spot bonds are sufficiently close as to provide secondary bonding between the spot bonds resulting in enhanced stretchability in both the machine direction and in the cross direction without excessive loss of strength. The nonwoven web is subjected to stretching in either the machine direction or in the cross direction or both resulting in permanent elongation in either direction in excess of about thirty (30%) percent and preferably about one hundred (100%) percent as illustrated in the graphs herein. In any event the coverage is greatly increased with commensurate reduction in basis weight of the web. The releasable filaments of the spot bonds are held for stabilizing the web, but the release strength of the filaments is such that the bonded intensity approaches but is less than the pull required for fracturing the filaments when the web is subjected to stress.

The spun bonded nonwoven web of the present invention is manufactured by depositing continuous filaments 10 of thermoplastic material such as from spinnerettes 11. The filaments pass through an oscillating guide 12 and are randomly deposited upon an endless conveyer 13 in the customary manner for making a spun bonded web. The web thus formed is fed between the nip of a roll 14 having a raised pattern and a heated smooth roll 15 producing a web 16 which is thereafter stretched in accordance with the invention as described below.

Figure 3:
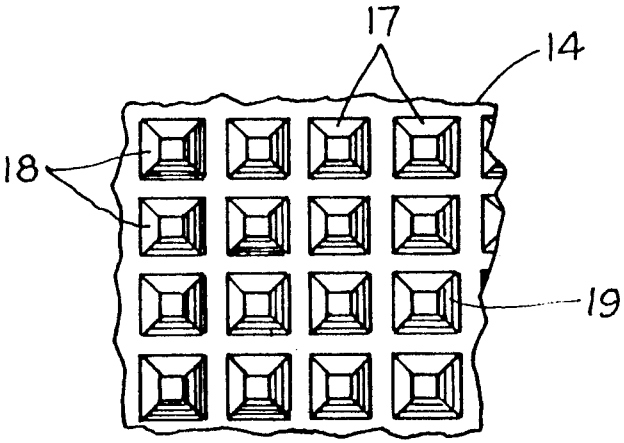
FIG. 3 is a developed view illustrating the pattern of a roll constructed in accordance with the invention illustrating spaced continuous rows of spaced raised portions arranged side by side in both the machine direction and in the cross direction.
Figure 2:
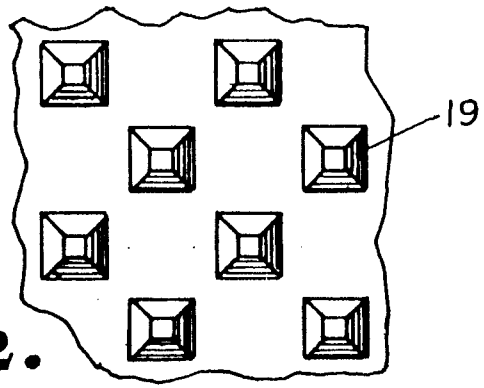
PRIOR ART Fig. 2.
FIG. 2 is a developed view illustrating the surface of a patterned roll constructed in accordance with the staggered pattern of the prior art.

The raised pattern of the roll 14 is illustrated in FIG. 3. Raised portions are in spaced rows 17 and 18 in the machine direction and in the cross direction respectively. The serially spaced spot bonds are closely spaced and arranged in side by side closely spaced relation. This pattern is in contrast to the asymmetrical or staggered portion of the prior art illustrated in FIG. 2 wherein the raised portions 19 of the pattern are scattered in a widely spaced relation in diagonal spaced rows.

Figure 5:
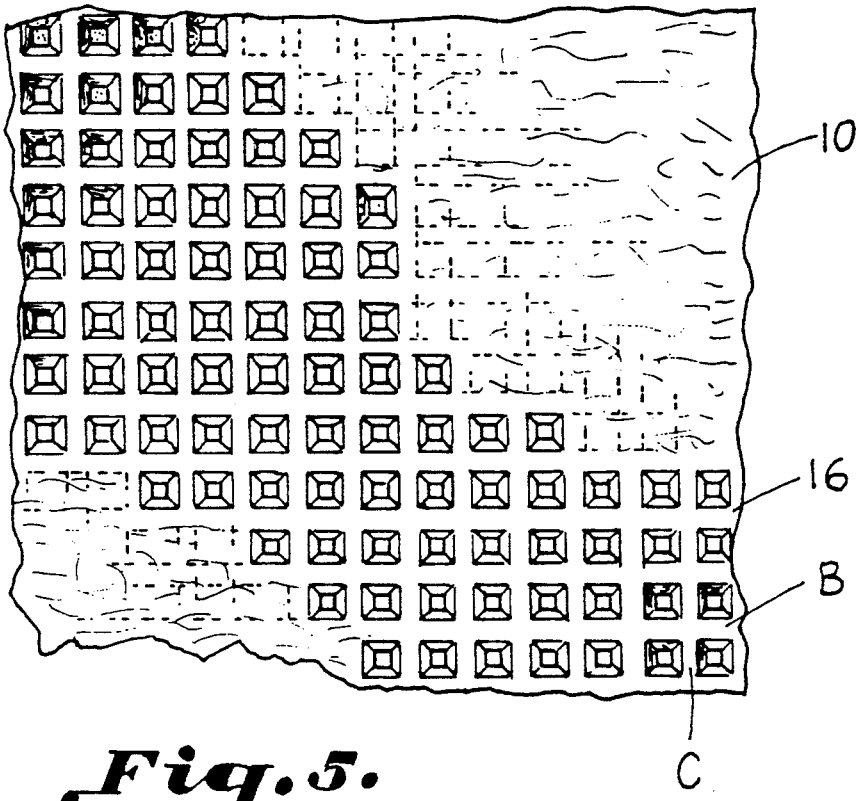
FIG. 5 is a top plan view illustrating a web constructed in accordance with the present invention.
Figure 4:
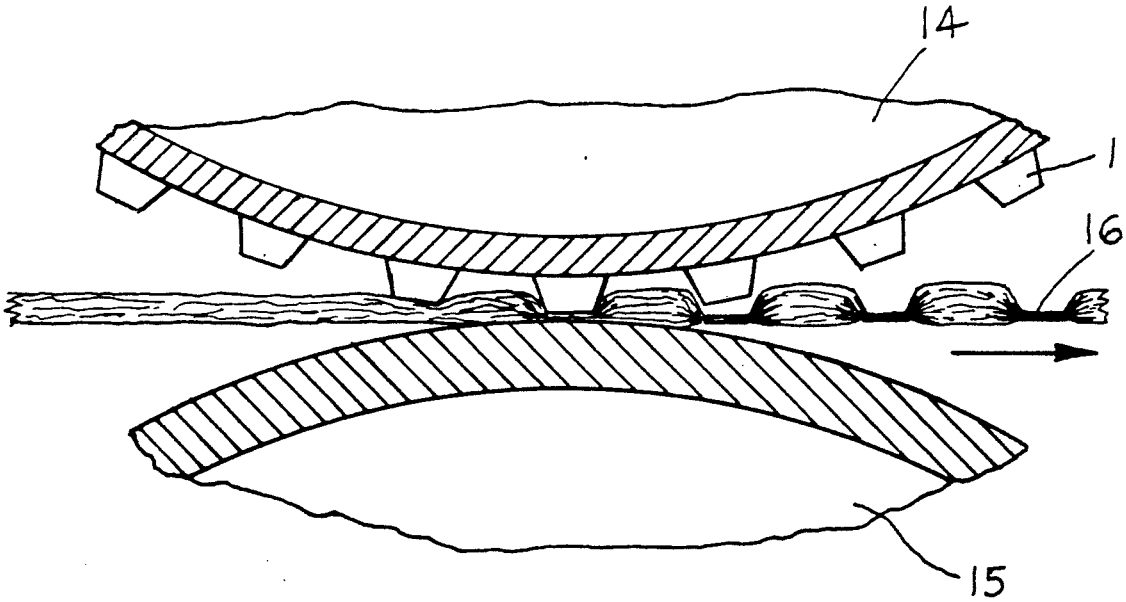
FIG. 4 is an enlarged transverse sectional elevation illustrating a patterned roll and a heated roll forming spot bonds in a spun bonded nonwoven web in accordance with the present invention.

The nip of the patterned roll 14 and the heated roll 15 is illustrated in FIG. 4 producing a spun bonded web 16 with autogenous spot bonds arranged in the pattern illustrated in FIG. 3. FIG. 5 illustrates a fabric 16 utilizing rolls illustrated in FIGS. 1, 3, 4 and 6.

Figure 6:
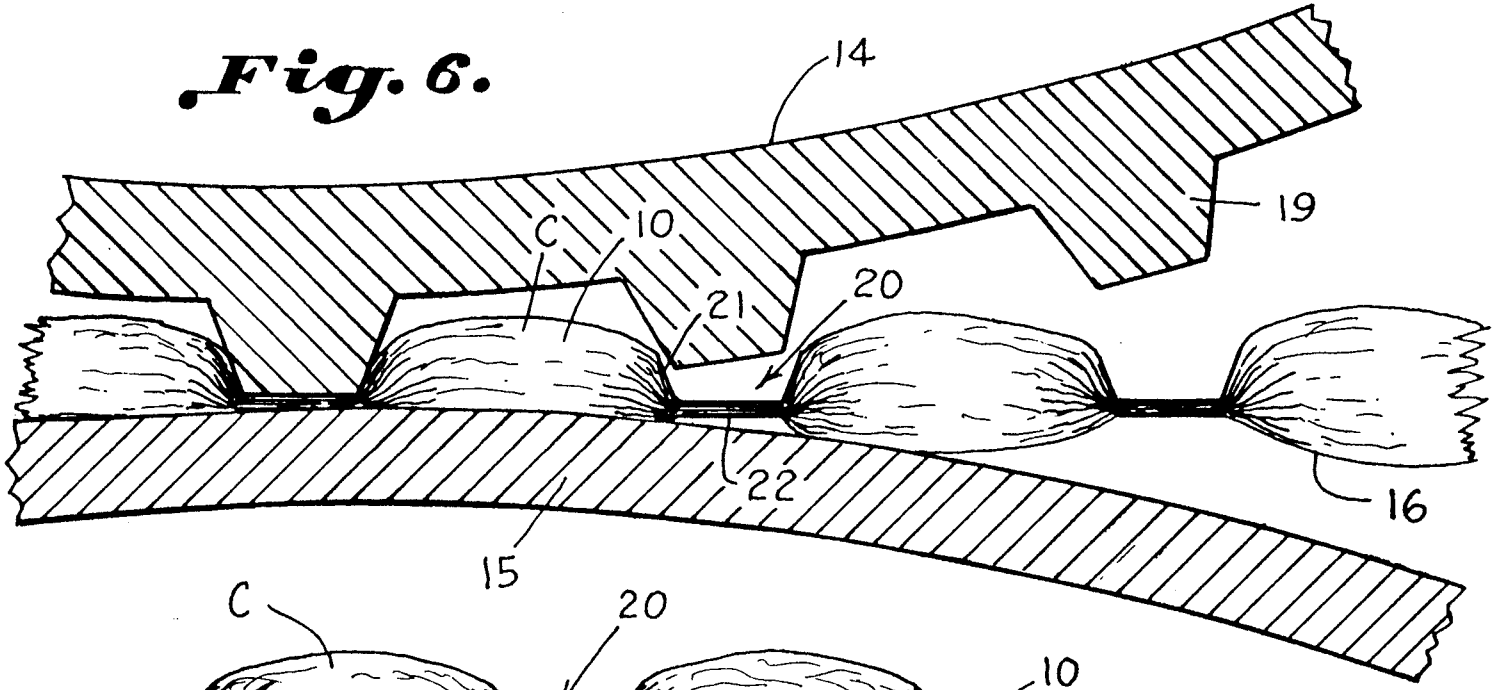
FIG. 6 is a further enlarged transverse sectional elevation illustrating a web being constructed in accordance with the invention with the cross section thereof taken in the longitudinal direction.
Figure 7:
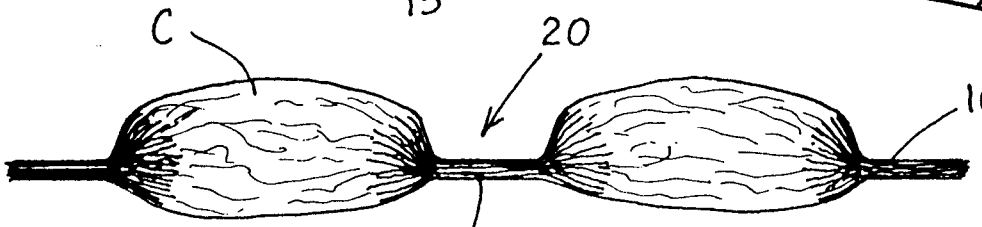
FIG. 7 is a sectional elevation similar to FIG. 6 further illustrating a nonwoven web of FIG. 6 after bonding.
Figure 8:
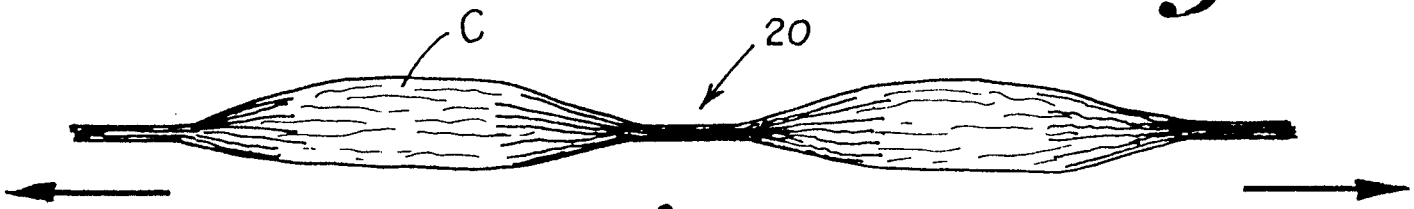
FIG. 8 is a further cross sectional elevation of the web after having been stretched in both the machine direction and in the cross direction.

FIG. 6 is an enlarged sectional elevation illustrating the web 16 with the ribs C disposed in the cross direction. The spot bonds A having a depression broadly designated at 20 have an upper surface 21 and a lower surface 22 recessed a lesser amount opposite the heated roll 15. FIG. 7 illustrates the rib C, while FIG. 8 illustrates the rib C and the bonds A having been stretched utilizing the apparatus illustrated in FIG. 11.

FIGS. 9 and 10 illustrate respective top and bottom elevations of the nonwoven fabric 25 constructed in accordance with the present invention. It will be noted that the continuous filaments 26 in the machine direction are oriented in the continuous strips or ribs B, while the filaments 27 in the ribs or strips C in the machine direction are predominately oriented continuously in that direction. This may occur as a result of the raised portions of the pattern parting some of the loose randomly distributed filaments becoming oriented in this fashion as the raised portions separate them upon compression of the web in the marginal areas of the web adjacent the spot bonds.

Figure 11:
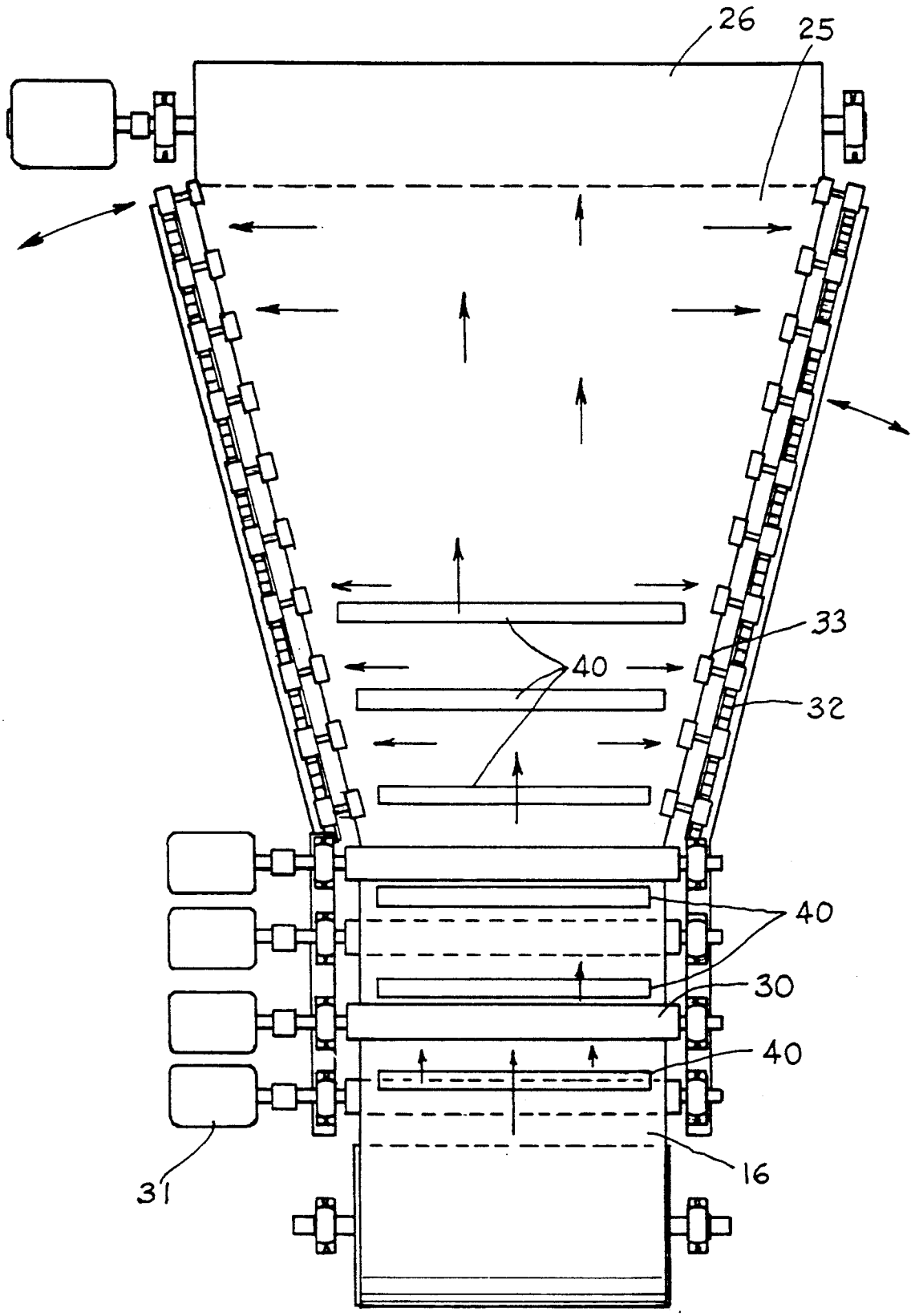
FIG. 11 is a schematic top plan view illustrating apparatus for sequentially stretching a spun bonded nonwoven web which has been spot bonded in accordance with the present invention in both the machine direction and in the cross direction.
Figure 12:
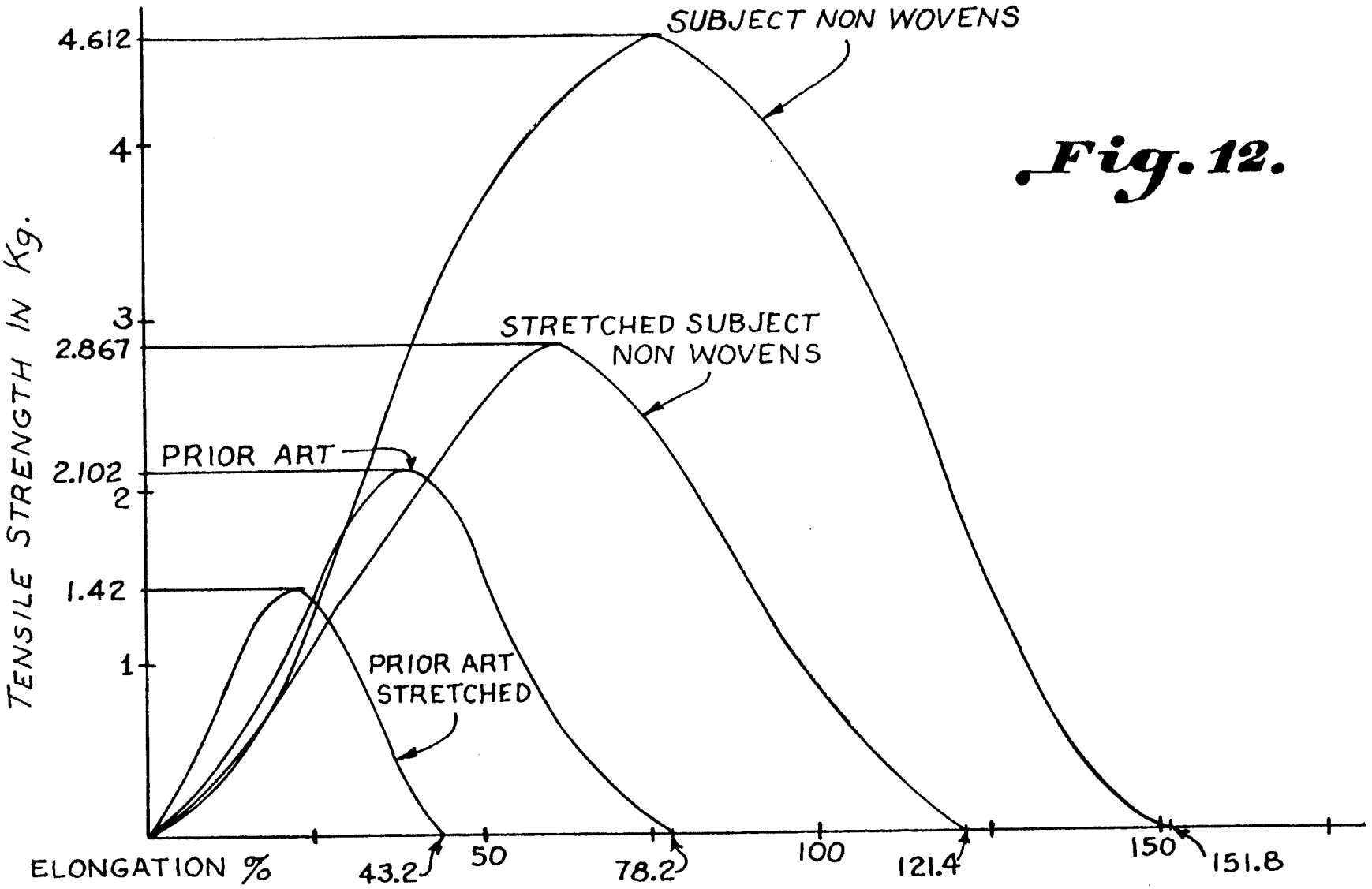
FIG. 12 is a graph comparing the cross direction strengths both before and after stretching a web constructed in accordance with the present invention with a web constructed in accordance with the prior art.
Figure 13:
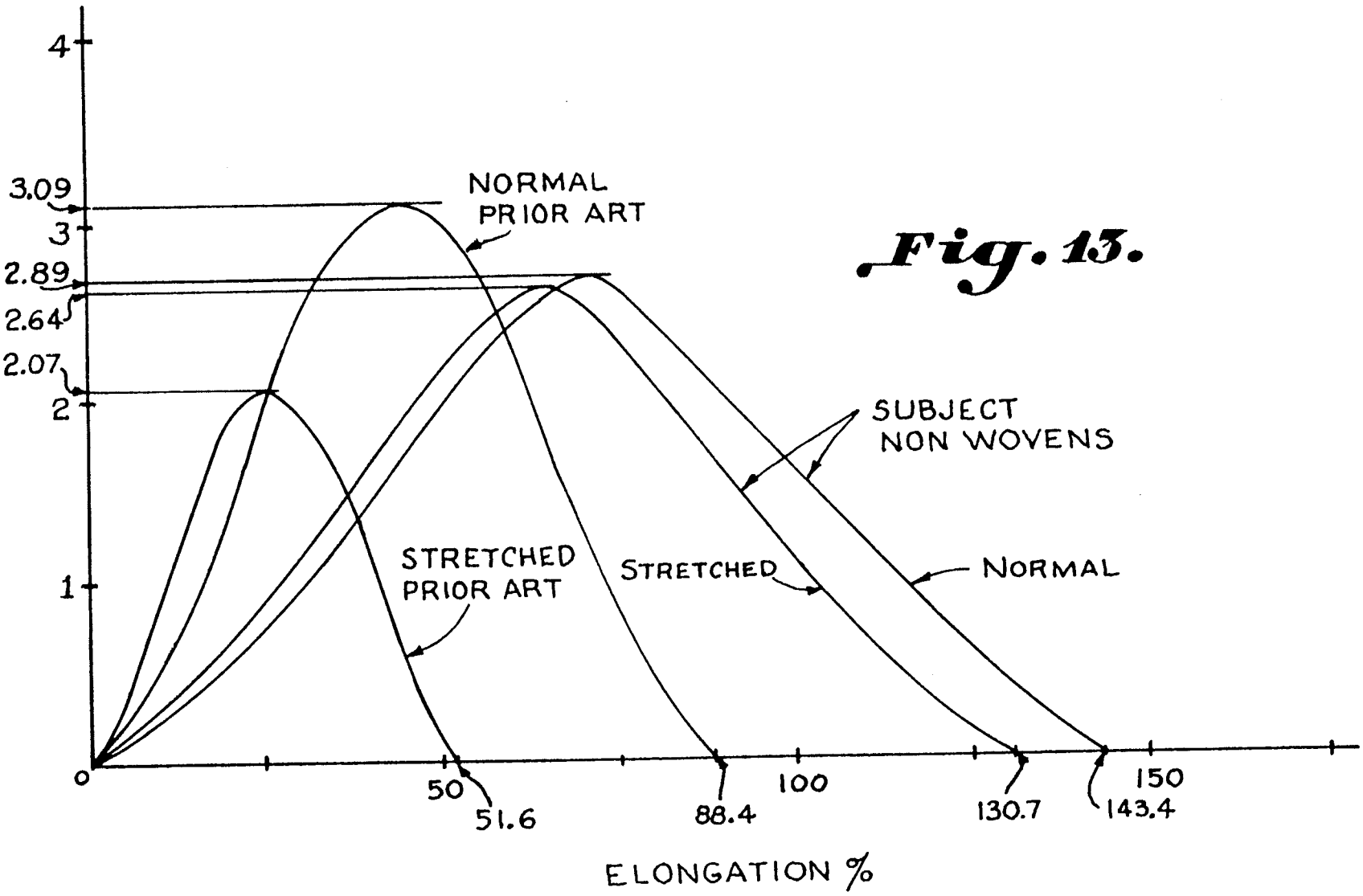
FIG. 13 is a graph comparing the strengths of a web constructed in accordance with the present invention in the machine direction before and after stretching with such values of a web constructed in accordance with the prior art.

Referring now to FIG. 11, apparatus is illustrated for imparting stretch in the machine direction through the use of rolls 30 which attenuate the web 16. Each of the rolls 30 is driven faster a preceding roll as through the use of a suitable DC motor 31. The web 16 which is stretched in the machine direction is then introduced to a tenter between chains 32 and clips 33 for stretching the fabric in a cross direction resulting in the finished web 25 which is wound into a roll 26. Examples of the characteristics of webs which have been manufactured and stretched in accordance with the present invention are set forth below. If desired infrared heaters providing an adjustable heat source of about 260° F. may be provided as illustrated at 40 to provide increased stretchability and to vary the characteristics of the web.

Prior Art—Average Weight—42.64 $gly^2$

Subject Nonwoven—Avg. Wt.—42.18 $gly^2$

Tensile strengths are averages taken from an Instron machine Model 1011. Gage length is 5.00 inches and speed 5.00 in/min. Samples were taken of the materials being 9"×11" with the length in the machine direction. The samples were weighed and cut into 1 inch strips with the exception of the material to be stretched. The samples to be stretched were first folded into a 1-2 inch bundle with the length being machine direction. Samples were then placed in the Instron machine and clamped using approximately ½ inch of material on each end. The material was than stretched 5.55 inches, released, refolded and stretched cross directionally for a distance of 4.45 inches. One (1) inch samples were cut from the resulting material.

The resulting data follows: Note elongation values are at break-point.

| | | Tensile in. Kg | Elongation % (% of 5 in.) |
|---|---|---|---|
| Prior Art | CD | 2.102 | 78.2 |
| | MD | 3.09 | 88.4 |
| Stretched | CD | 1.42 | 43.2 |
| | MD | 2.07 | 51.6 |
| Subject Fabric | CD | 4.612 | 151.8 |
| Normal | MD | 2.689 | 143.4 |
| Stretched | CD | 2.857 | 121.4 |

-continued

| | | | |
|---|---|---|---|
| | MD | 2.64 | 130.7 |
| Elongation Values | CD | — | 210.4 |
| With Pre-Stretching Factored In | MD | — | 241.7 |

| % | Actual Stretch | Deformation | Def. as % of Stretch |
|---|---|---|---|
| 5 | .25 in | .0625 in | 25 |
| 10 | .50 in | .0810 in | 16.2 |
| 15 | .75 in | .2190 in | 29.2 |
| 20 | 1.00 in | .2500 in | 25 |
| 25 | 1.25 in | .5625 in | 45 |
| Average | | | 28.1 |

Deformation occurs even at low percentages of stretch, and for these low stretches the deformation tends to be in the neighborhood of 25% of stretch. Therefore, lower limits of stretch without deformation of the material seems to be unobtainable.

Thus, use of the process of the invention results in a web which possesses improved strength and elongation characteristics over unstretched webs of comparable spun bonded construction. The web retains these qualities despite stress which would meet or exceed the capabilities of comparable prior webs such as a pre-stretching which meets or exceeds the elasticity limits of the similar weight of such prior webs.

While a preferred embodiment of the invention has been described using specific terms, such description is for illustrative purposes only, and it is to be understood that changes and variations may be made without departing from the spirit or scope of the following claims.

What is claimed is:

1. A soft stretchable spun bonded nonwoven web comprising:

a plurality of continuous and randomly deposited, molecularly oriented filaments of a thermoplastic polymer forming a web;

said web having a plurality of spaced spot bonds of autogenous releasable filament bonds having been formed by passing said web between a roll with a raised pattern thereon and another opposed roll exerting pressure and applying heat to said web;

said spot bonds being distributed in a pattern providing continuous strips of unbonded filaments therebetween aligned in both the machine direction and in the cross direction throughout the web;

said spot bonds being in rows and in side by side relation in both the machine direction and in the cross direction;

said continuous strips being of such width that respective spot bonds are sufficiently close as to provide secondary bonding between said spot bonds resulting in enhanced stretchability in both the machine direction and in the cross direction without substantial loss of strength; and said releasable filament bonds serving to hold the filaments for stabilizing the web and the release strength of the filaments being such that the bonded intensity approaches but is less than the pull required for fracturing the filaments when the web is subjected to strain.

2. A soft stretchable spun bonded nonwoven web comprising:

a plurality of continuous and randomly deposited, molecularly oriented filaments of a thermoplastic polymer forming a web;

said web having a plurality of spaced spot bonds of autogenous releasable filament bonds having been formed by passing said web between a roll with a raised pattern thereon and another opposed roll exerting pressure and applying heat to said web;

said spot bonds being distributed in a pattern providing continuous strips of unbonded filaments therebetween aligned in both the machine direction and in the cross direction throughout the web;

said spot bonds being in rows and in side by side relation in both the machine direction and in the cross direction;

said continuous strips being of such width that respective spot bonds are sufficiently close as to provide secondary bonding between said spot bonds resulting in enhanced stretchability in both the machine direction and in the cross direction without substantial loss of strength;

said nonwoven web having been subjected to stretching in at least one direction axially of said rows resulting in permanent elongation in excess of about 30%; and said releasable filament bonds serving to hold the filaments for stabilizing the web and the release strength of the filaments being such that the bonded intensity approaches but is less than the pull required for fracturing the filaments when the web is subjected to strain.

3. A spun bonded nonwoven fabric comprising:

continuous thermoplastic filaments substantially uniformly randomly oriented in the machine direction and in the cross direction;

said filaments oriented in the machine direction crossing those oriented in the cross direction at locations across said fabric in the machine direction and in the cross direction;

some of said filaments being autogenously fused and bonded at said locations across said fabric in the machine direction and in the cross direction;

said locations being in rows and in side by side relation in both the machine direction and in the cross direction; and said fabric being axially stretched at least about 30% providing substantially increased cross sectional area thereof;

whereby a softer hand is imparted to the fabric as well as increased loft.

4. The structure set forth in claim 3 wherein said fabric is axially stretched in the machine direction.

5. The structure set forth in claim 4 wherein said fabric is axially stretched in the cross direction.

6. A spun bonded nonwoven fabric comprising:

continuous filaments substantially uniformly randomly oriented in the machine direction and in the cross direction;

said filaments oriented in the machine direction crossing those oriented in the cross direction at locations across said fabric in the machine direction and in the cross direction;

a plurality of spaced discrete areas wherein said filaments are autogenously bonded at said locations in said discrete areas by the application of heat and pressure;

said locations being in rows and in side by side relation in both the machine direction and in the cross direction; and said discrete areas being oriented in side by side relation in the machine direction and in the cross direction forming continuous ribs aligned in both the machine direction and in the cross direction;

whereby increased stretchability is imparted to the fabric.

7. The structure set forth in claim 6 wherein said fabric is axially stretched in the machine direction providing substantially increased cross sectional area thereof.

8. The structure set forth in claim 7 wherein said fabric is axially stretched in the cross direction.

9. The method of making a spun bonded fabric having continuous randomized filaments bonded by heat and pressure exerted by a patterned roll to afford tensile strength in the cross direction as well as in the machine direction at locations in rows in side by side relation in both the machine direction and in the cross direction in order to improve the hand and the loft of the spun-bonded fabric comprising the steps of:

feeding said spun-bonded fabric in open width to a stretching apparatus for exerting a tensile force in the cross direction as well as in the machine direction;

progressively increasing said tensile force in the cross direction as well as in the machine direction while moving said spun-bonded fabric through said stretching apparatus subjecting the fabric to the stretching action of such stretching apparatus; and packaging the spun-bonded fabric which has been thus treated;

whereby such treatment results in a fabric having a softer hand and increased loft.

10. The method set forth in claim 9 including applying said tensile force in the cross direction and in the machine direction sequentially and applying heat to said fabric during stretching.

11. The method set forth in claim 10 including applying said tensile force in the machine direction before applying tensile force in the cross direction.

12. A spun bonded fabric comprising:

continuous radomized filaments bonded by heat and pressure exerted by a patterned roll at locations in rows in side by side relation in both the machine direction and in the cross direction to afford tensile strength in the cross direction a well as in the machine direction;

said continuous radomized bonded filaments being stretched in the cross direction and in the machine direction; and said continuous radomized bonded filaments having been stretched having a softer hand and increased loft in respect to a fabric which had not been so stretched.

13. The structure set forth in claim 12 wherein said continuous randomized bonded filaments are stretched by at least about 30% in the machine direction and in the cross direction, and wherein said patterned roll provides discrete bonded areas arranged in continuous rows in both the cross direction and in the machine direction.

14. The structure set forth in claim 13 wherein heat is applied to said fabric during stretching.

* * * * *